US005344022A

United States Patent [19]

Stahl

[11] Patent Number: 5,344,022

[45] Date of Patent: Sep. 6, 1994

[54] STACKABLE AND NESTABLE MULTI-LEVEL BREAD TRAY

[75] Inventor: Edward L. Stahl, Plano, Tex.

[73] Assignee: Piper Industries of Texas, Inc., Garland, Tex.

[21] Appl. No.: 154,479

[22] Filed: Nov. 19, 1993

[51] Int. Cl.[5] ..... B65D 21/04

[52] U.S. Cl. ..... 206/507; 206/505; 206/511; 206/512

[58] Field of Search ..... 206/505, 506, 507, 509, 206/511, 512, 518, 519

[56] References Cited

U.S. PATENT DOCUMENTS

| | | | |
|---|---|---|---|
| 3,392,877 | 7/1968 | Sanders | 206/507 |
| 3,420,402 | 1/1969 | Frater et al. | 206/507 |
| 4,106,623 | 8/1978 | Carroll et al. | 206/506 |
| 4,189,052 | 2/1990 | Carroll et al. | 206/507 |
| 4,211,327 | 7/1980 | Stahl et al. | 206/505 |
| 4,457,433 | 7/1984 | Wilson | 206/505 |
| 4,520,928 | 6/1985 | Wilson | 206/505 |
| 4,960,207 | 10/1990 | Tabler et al. | 206/507 |
| 5,035,326 | 7/1991 | Stahl | 206/507 |

*Primary Examiner*—Allan N. Shoop
*Assistant Examiner*—Stephen Cronin
*Attorney, Agent, or Firm*—Mason, Fenwick & Lawrence

[57] ABSTRACT

A stackable, nestable, multi-level tray or basket useful for storing and transporting baked goods is provided which includes a floor and a pair of upstanding side walls configured for stacking identical trays as well as allowing the stacking of a tray with smaller, overall dimensions. The structure enables identical trays to slide on to each other in stacked or nested configurations. A multi-level tray includes sidewalls with a plurality of upright stacking posts extending from the floor to a vertical strip of material. Each stacking post flares out at its top end to a cantilevered, extending flat portion. Trays of smaller overall dimensions than the disclosed tray can be advantageously stacked on these extending flat portions.

11 Claims, 6 Drawing Sheets

STACKABLE AND NESTABLE MULTI-LEVEL BREAD TRAY

BACKGROUND OF THE INVENTION

1. Field of the Invention

The present invention concerns a slide-on type stackable, nestable, multi-level bread tray or basket (the terms tray and basket are interchangeably used herein) especially used for storing baked goods, such as cake, buns, and bread loaves therein. The slide-on, multi-level inventive baskets or trays hereof are advantageously configured to receive and support a second, complimentarily configured tray thereon in either stacked or nested manner, and also allow the stacking of a basket with smaller, overall dimensions.

2. Related Art

It is well known in the operation of bakeries to provide a rigid supporting container in the form of a tray or basket to protect baked goods from damage incident to handling, transport and storage thereof. In most recent years, bakeries have produced a variety of different baked goods, such as loaves, cakes, and hamburger buns. Each of these products is conventionally produced in different product heights, resulting in the need to economically protect all such goods while avoiding the necessity of having different trays or baskets for each product.

As a result, there have been developed a number of different multi-level, stacking trays or baskets which are advantageously designed to stack or nest at different levels according to the height of the product contained therein. For example, a second tray could be superposed over a first tray at a first, lower level for hamburger buns, and at a second, upper level for loaves of bread. Examples of different stacking trays include those shown in the following U.S. Pat. No. 3,387,740 to Bockenstette; U.S. Pat. No. 4,093,070 to Stahl; U.S. Pat. No. 4,106,623 to Carroll et al.; U.S. Pat. No. 4,211,327 to Stahl et al.; U.S. Pat. No. 4,600,103 to Tabler; and U.S. Pat. No. 4,759,451 to Apps.

A difficulty inherent in prior known baskets has been their inability to nest or stack at alternate levels without aligning the upper basket directly over the lower basket. Those problems have largely been overcome by the slide-on, multi-level basket of prior application Ser. No. 07/950,005, filed Sept. 24, 1992 and entitled Slide On Multi-Level Basket, the contents of which are hereby incorporated by reference. The Slide On Multi-Level Basket of said application enables a second basket to slide on to the first basket before dropping into either of its stack or nest positions.

However, a limitation inherent in existing slide-on, multilevel baskets is the requirement that only baskets of similar configuration and overall dimensions can be stacked or nested. Whereas in actual practice, there is a frequent need to stack a basket of smaller overall dimensions on top of one of a larger slide-on, multi,level basket; thus, an object of the present invention is to provide a solution to this need.

SUMMARY OF THE INVENTION

The slide-on, multi-level tray or basket of the present invention allows the stacking on the slide-on, multi-level tray of a basket with smaller overall dimensions than the dimensions of the slide-on, multi-level basket. The preferred embodiment of the present invention is directed to a tray which includes a pair of opposed left and right side-walls, a pair of opposed front and rear walls, and a floor. The preferred embodiment is symmetrical about a plane of symmetry which is perpendicular to the floor and parallel to the left and right side-walls. The left and right side-walls are mirror-images of each other and each have a plurality of normally upright, spaced apart stacking posts of substantially uniform width and height. Each of the stacking posts has a top end, a bottom end, an inner side and an outer side. The stacking posts are interconnected at their top ends by a vertical strip of material. This strip of material is spaced above the floor by a predetermined distance. The stacking posts are connected directly to the floor, thereby leaving a void that extends between each of the stacking posts and from the floor to the vertical strip of material. The vertical strip of material has an upper rim which extends along the vertical strip, wherein the upper rim is a constant height for a portion of its length and then tapers off to a lower height at an end of the rim closest to the rear wall. Each of the stacking posts is flared inwardly in cantilever manner toward the center of the tray at the top end and includes a horizontally extending flat portion. This flat portion cantilevers out from the inner side of each stacking post towards the plane of symmetry. This flat portion also has a vertical lip at an edge closest to the plane of symmetry, thereby providing a surface on which a basket having smaller overall dimensions can be stacked and retained. The stacking posts in the present invention each have a downwardly extending lip at the bottom end of the outer side of the stacking posts. The stacking posts are each connected to the floor by connecting portions. Each connecting portion has a top side and a bottom side, wherein an inverted V-shaped recess is formed in the bottom side of the connecting portion. Similarly configured baskets or trays of the present invention have predetermined dimensions so that nesting a first one of the baskets on top of a second one of the baskets which is nested in turn on top of a third one of the baskets results in the bottom ends of the stacking posts of the first one of the baskets resting on the horizontally extending flat portions at the top ends of the stacking posts of the third one of the baskets. The downwardly extending lips of any one of the baskets serves the purpose of guiding that basket along the upper rims of any other of the baskets when that one basket is slid into a stacked position on top of the other basket. When an upper first basket is stacked on a similarly configured lower second basket, the V-shaped recesses formed in the bottom side of the connecting portions of each of the stacking post of the first basket are positioned adjacent but outwardly of the vertical lips of the extending flat portions of the stacking posts of the second basket.

BRIEF DESCRIPTION OF THE DRAWINGS

The invention is better understood by reading the following Detailed Description of the preferred embodiments with reference to the accompanying drawing figures, in which like reference numerals refer to like elements throughout, and in which.

DETAILED DESCRIPTION OF THE PREFERRED EMBODIMENT8

Figure 1:
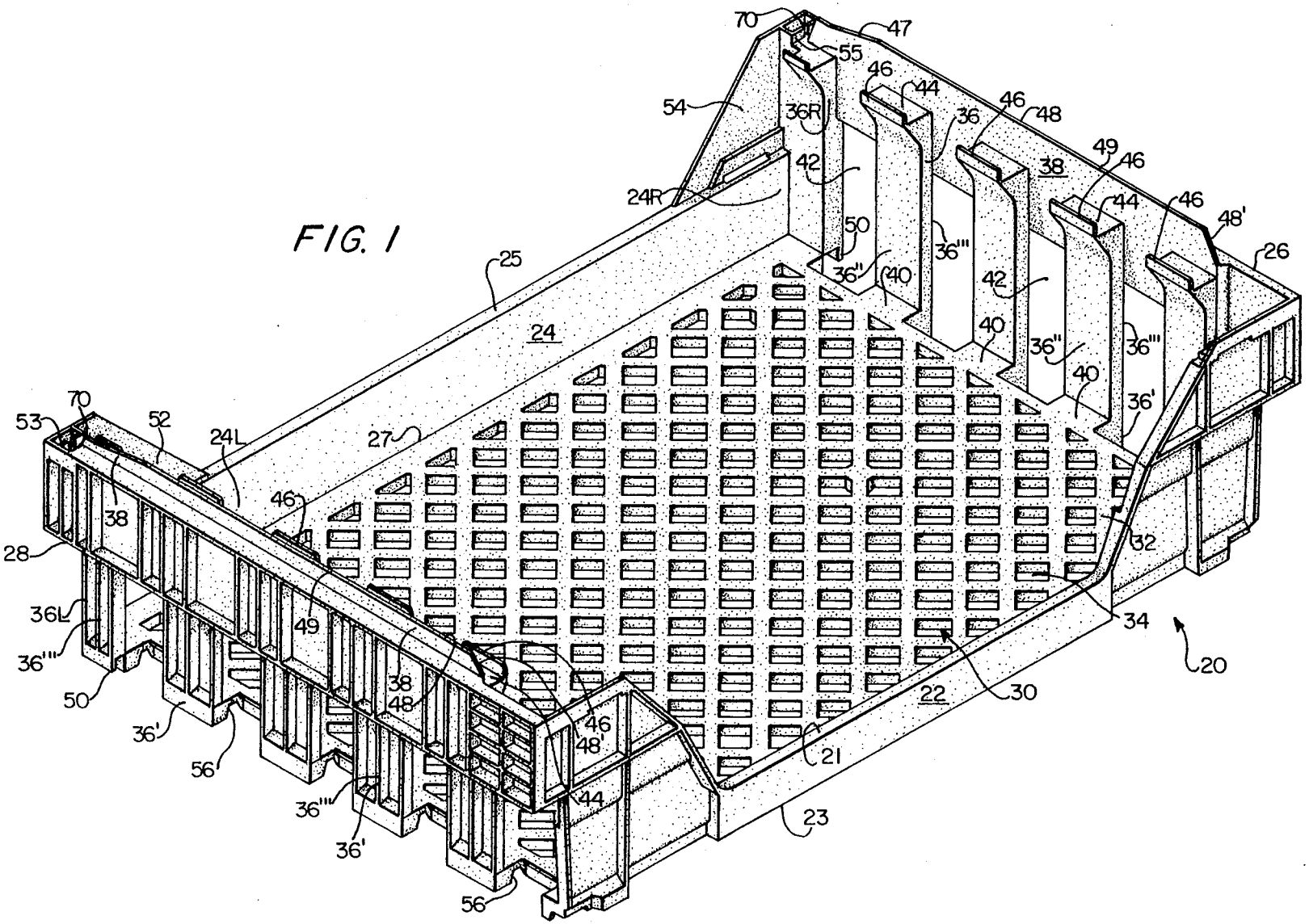
FIG. 1 is a front perspective view of the stackable, nestable, slide-on, multi-level tray or basket of the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring now to the drawings, a stackable, nestable, multilevel basket or tray 20 as shown in FIG. 1 broadly includes a front wall 22 having an upper surface 21 and a lower surface 23, a rear wall 24 having an upper surface 25 and a lower surface 27, a rightside wall 26, a left-side wall 28, and a lattice-like floor 30 filling the space between walls 22, 24, 26 and 28. Right-side wall 26 and left-side wall 28 are substantially mirror images of one another, whereby similarly configured baskets may be placed on basket 20 in different orientations to enable alternative highlevel aligned mode stacking or alternate mode nested stacking. Tray 20 can advantageously be constructed by injection molding whereby the entire tray may be formed as a unitary article from a synthetic resin such as polyethylene.

The trays are capable of being stacked in either of two possible modes. The first mode is the "aligned" mode in which the front wall of each tray is vertically aligned with the front wall of all other trays in the stack in the manner of the three trays shown in the "stacked" array of FIG. 7 and 9. The second mode is the "alternate" mode in which the front and rear walls alternate on the front and rear sides of the stack as shown in the "nested" stack of FIGS. 6 and 8.

In greater detail, floor 30 as shown in FIG. 1 includes a series of selectively spaced ribs 32 provided in lattice-like array to define a large number of uniformly spaced openings 34 therebetween. Right and left side walls 26 and 28 are mirror images of each other and have a plurality of normally upright, spaced apart stacking posts 36 of substantially uniform width and height. Each of the stacking posts 36 has a flat top end portion 44, a bottom end 36' an inner side 36'' and an outer side 36'''

Figure 2:
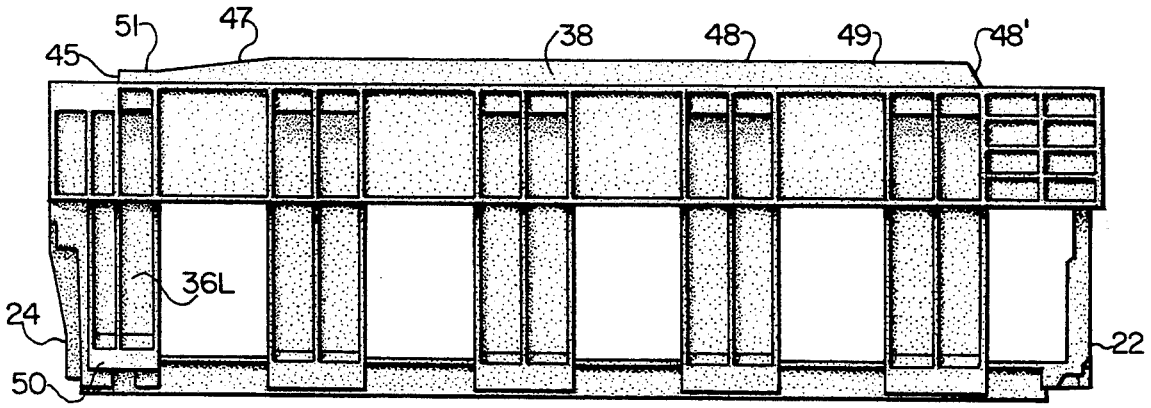
FIG. 2 is a left side elevational view of the stackable, nestable, slide-on, multi-level tray or basket of FIG. 1.
Figure 3:
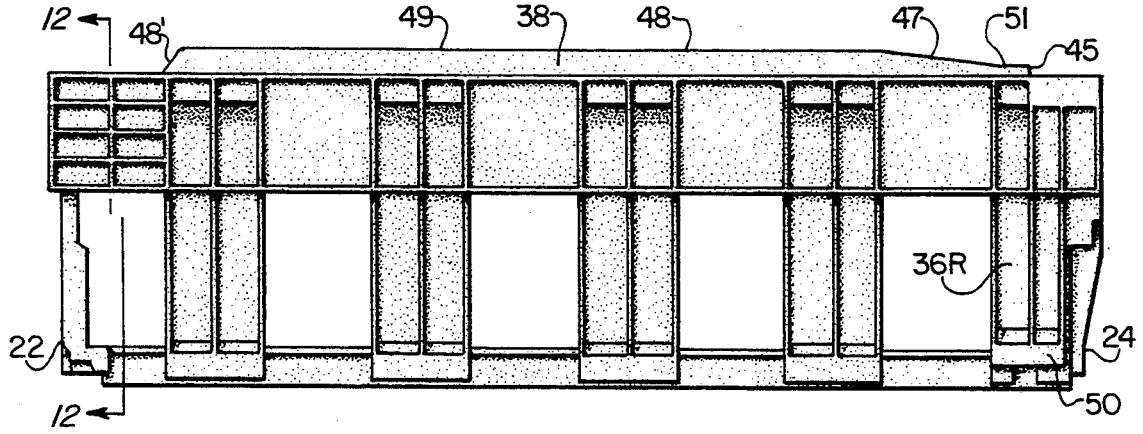
FIG. 3 is a right side elevational view of the stackable, nestable, slide-on, multi-level tray or basket, and is a mirrorimage of the left side elevational view of FIG. 2.
Figure 4:
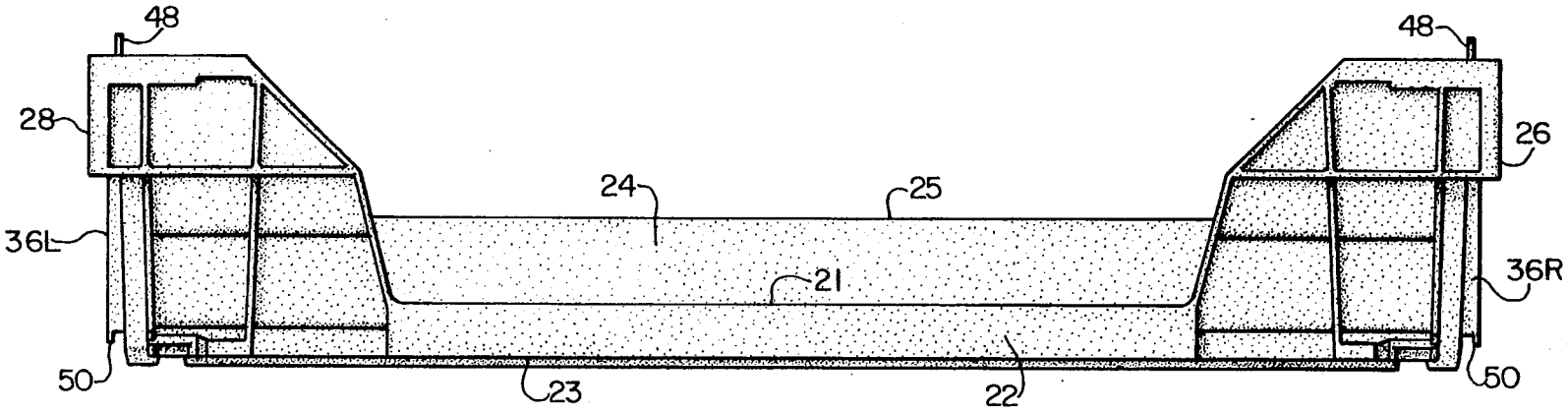
FIG. 4 is a front elevational view of the multi-level tray or basket shown in FIG. 1.

Referring to FIGS. 1–3, stacking posts 36 are interconnected at their top ends by a vertical panel or strip of material 38, which is spaced above the floor by a predetermined distance, and which has a rear edge 45 and a front edge 48'. Stacking posts 36 are each connected through connecting portions 40 (FIG. 1) directly to floor 30, thereby leaving voids 42 that extend between each of the stacking posts 36 and which also extend from floor 30 to the top portions 44 with vertical strip of material 38 defining the rearward extant of voids 42. At their top ends stacking posts 36 flare inwardly relative to the basket in a cantilevered manner. Each of the flat top end portions 44 terminates in a vertical lip 46 at the edge closest to the plane of symmetry as shown in FIG. 1. The cantilevered inwardly flaring top portions 44 and associated lips 46 permit smaller trays than those illustrated to be stacked on the subject inventive trays 20.

Figure 10:
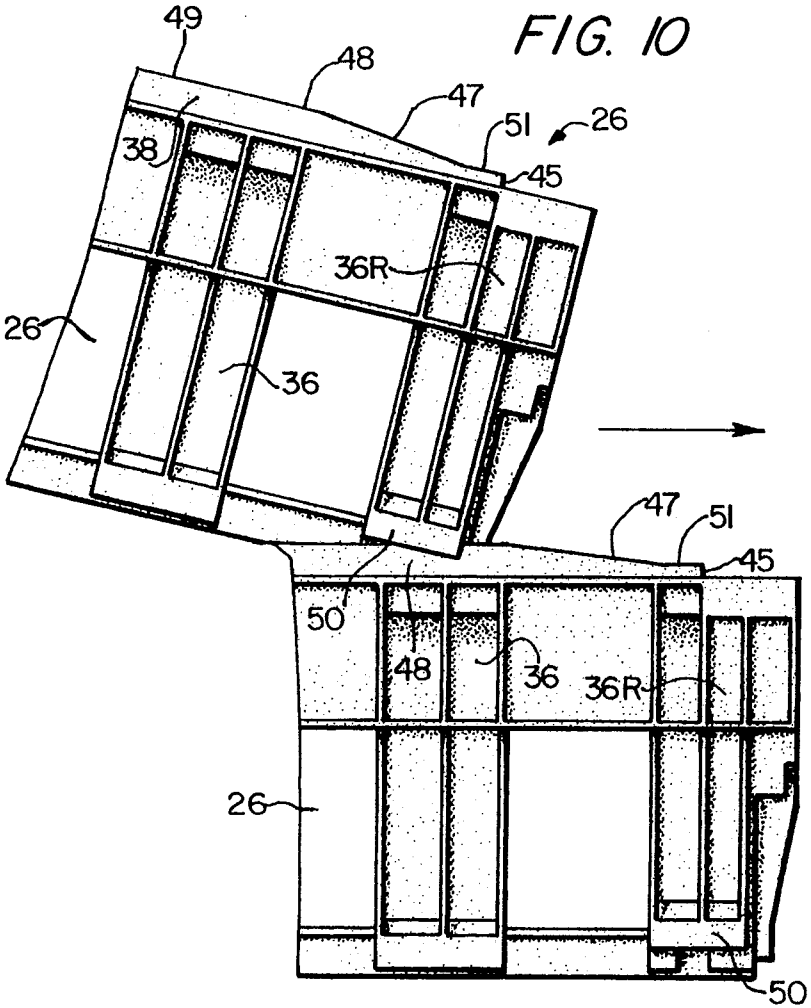
FIG. 10 is a right side elevational view of an upper tray or basket being slid into a stacked position on top of a lower tray or basket.

Vertical strip 38 has an upper rim 48 extending along its length which has an upper horizontal surface 49 of constant height extending from its front edge 48' to a downwardly inclined surface (FIG. 10) 47 which terminates rearwardly at a lower horizontal surface 51 which terminates rearwardly at rear edge 45 as best shown in FIGS. 2 and 10.

Figure 5:
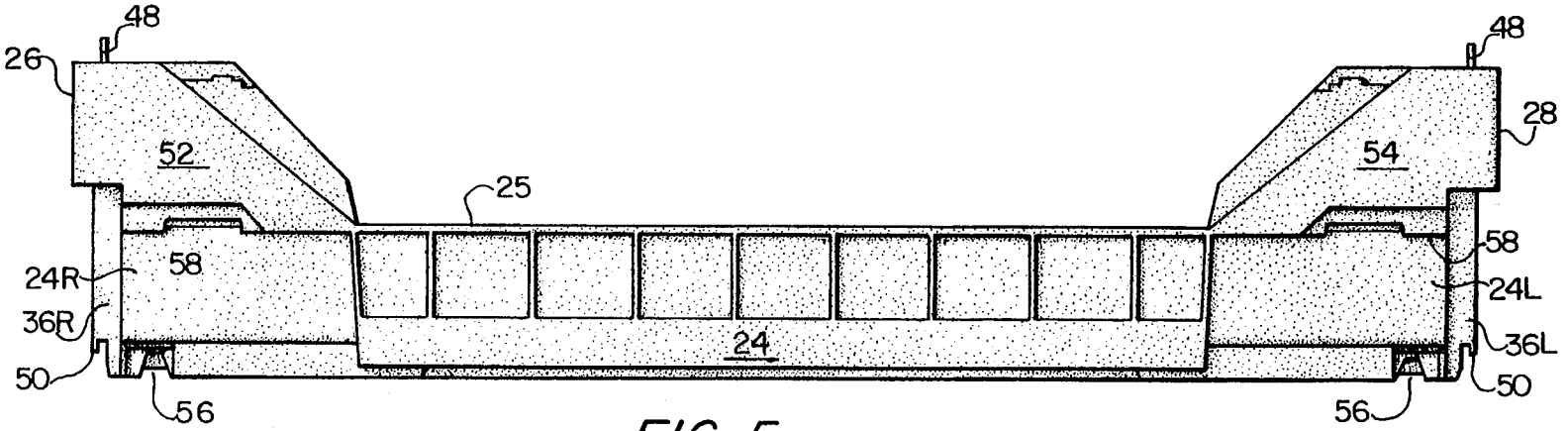
FIG. 5 is a rear elevational view of the multi-level tray or basket of FIG. 1.
Figure 12:
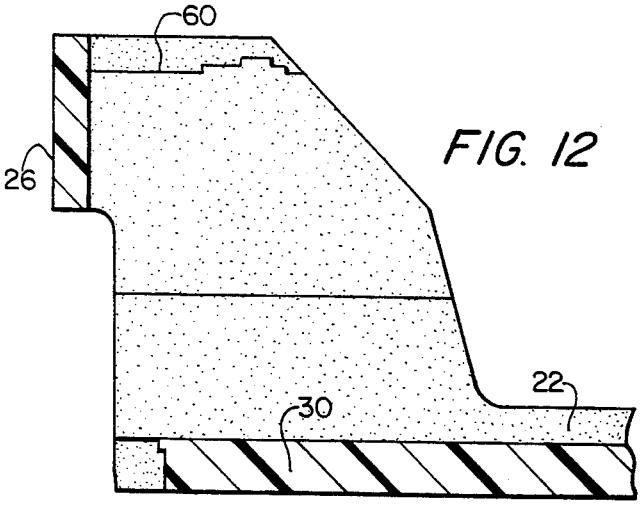
FIG. 12 is a sectional view taken along lines 12—12 of FIG. 3.

Rear wall 24 has a left end 24L and a right end 24R as shown in FIG. 5. The left end 24L is connected to the inner side of a left rearmost stacking post 36L. The right end 26R is connected to the inner side of a right rearmost stacking post 36R. Horizontal downwardly facing support pillars 58 (FIG. 5) are provided at the ends of the rear wall 24 for engagement with upwardly facing abutment surfaces 60 (FIG. 12) adjacent the ends of front wall 22 of a lower tray when the trays are in nested array. Stacking posts 36 are spaced at substantially equal distances from each other. Additionally, each stacking post in the right sidewall 26 is facingly aligned with a corresponding stacking post in the left sidewall 28. It should be noted that the front-to-rear dimension of right and left rearmost stacking posts 36R and 36L is less than the front-to-rear dimension of the other stacking posts.

The left rearmost stacking post 36L and the right rearmost stacking post 36R each have a downwardly extending lip 50 at the bottom end of their outer sides as best shown in FIGS. 1–4. The two downwardly extending lips 50 are spaced apart a distance which is greater than the distance between upper rims 48 of the vertical strips 38 for each basket. This positioning of downwardly extending lips 50 of an upper one of the baskets allows both of the lips 50 to straddle (i.e. be positioned outwardly of) rims 48 of a similarly configured lower basket when the two baskets are slid onto each other in the manner illustrated in FIGS. 10 and 11.

Figure 11:
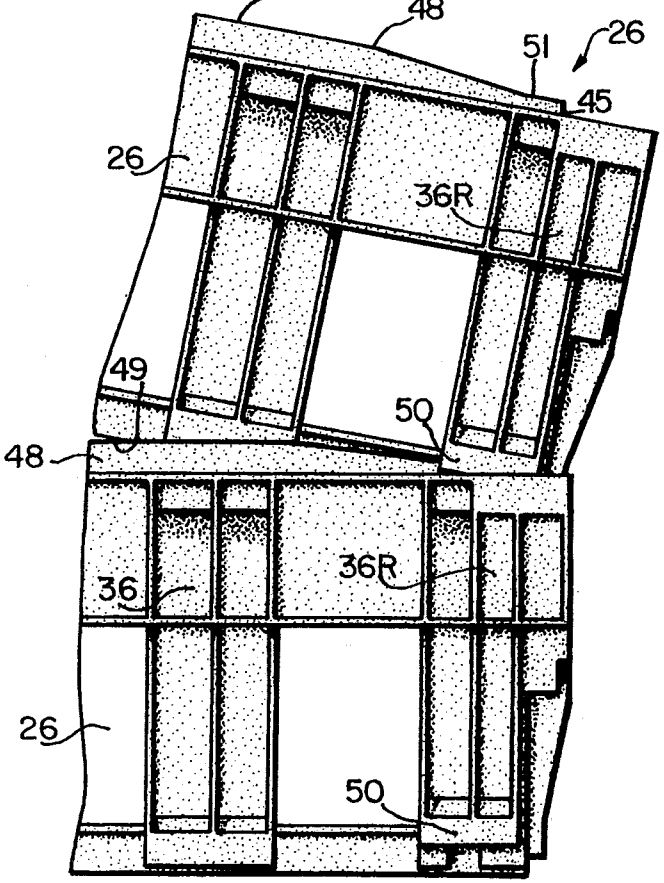
FIG. 11 is a right side elevational view of the upper multilevel basket of FIG. 10 in its rearmost position with its downwardly extending lips abutting the buttresses of the lower multi-level basket.

Front and rear walls 22 and 24 each have left and right buttresses 52 and 54 (FIGS. 1 and 5) which extend from left and right side-walls 28 and 26, respectively, toward the center of the tray. Similarly, transverse surfaces 53 and 55 (FIG. 1) are provided adjacent the rearmost upper surfaces of left-side wall 28 and right side wall 26 respectively. Each transverse surfaces 53, 55 has a vertical slot 70 into which lips 50 move when an aligned upper basket is slid onto an aligned lower basket. Referring to FIGS. 10 and 11, when an upper basket is slid into an aligned stacked position on a lower basket, the sliding movement is stopped when the inwardly positioned downwardly extending lips 50 of the upper basket moves through its aligned slot 70 and contacts one of the buttresses 52 or 54 of the lower basket.

All stacking posts 36 are connected to floor 30 by connecting portions 40 as shown in FIG. 1. Connecting portions 40 each have a top side and a bottom side, wherein an inverted V-shaped recess 56 (FIGS. 1 and 5) is formed in the bottom side of each connecting portion 40. When an upper basket is stacked in the aligned mode on top of a lower basket, each inverted V-shaped recess 56 of the upper basket rests over one of the vertical lips 46 of one of the stacking posts 36 on the lower basket as shown in FIG. 8.

Figure 6:
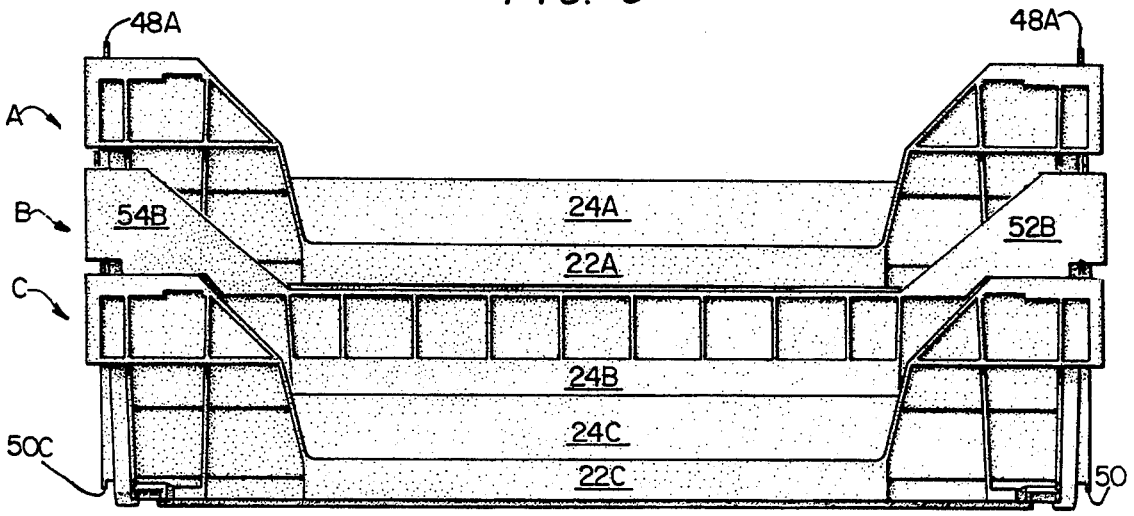
FIG. 6 is an elevational view of three identical multi-level trays or baskets in accordance with the present invention positioned in alternating superposed nested relationship.
Figure 7:
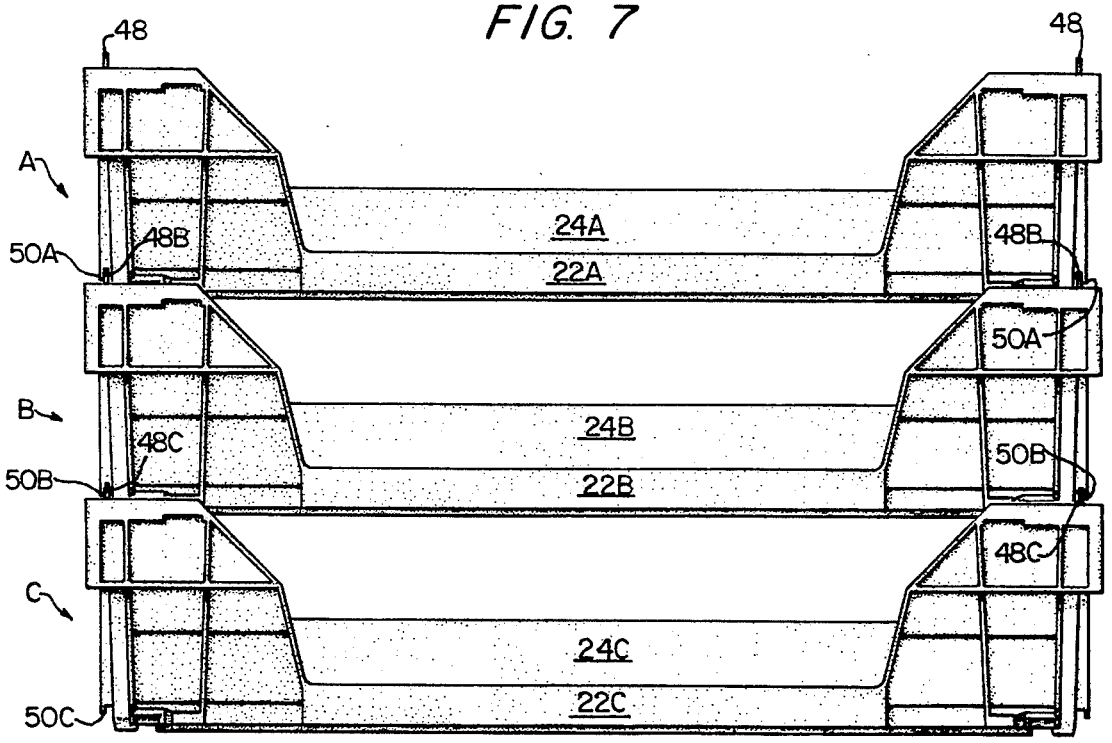
FIG. 7 is a front elevational view of three identical multilevel trays or baskets in accordance with the present invention positioned in superposed stacked relationship.

Front wall 22 of a tray according to the present invention is of a lower height than the rear wall 24, thereby allowing products to be loaded onto and off of the tray from the front of the tray when the trays are stacked in the aligned mode. When the front walls and the rear walls of plural trays are located in vertical alignment with each other in the aligned mode, the baskets are in the stacked configuration (as best shown by stacked top to bottom trays A, B and C in FIGS. 7 and 9). In this stacked configuration, the respective stacking posts 36 of all of the baskets are located in vertical alignment with each other with the lower end of post 36A of tray A nesting on the upper flat portion 4B of middle tray B and the lower end of post 36B rests on a flat portion 44C of lower tray C. However, when two similarly configured trays are superposed on one another in the alternate mode with the front wall of one tray located over top of the rear wall of the other tray, the two trays will nest inside of each other (as best shown in FIGS. 6 and 8).

When plural trays or baskets are in the nested configuration, their respective stacking posts 36 are interleaved with each other. Thus, when three trays (A, B and C from top to bottom) are nested inside of each other as best shown in FIG. 8, the bottom ends of the respective stacking posts 36A of the top tray A rest on the horizontally extending flat portions 44C at the top ends of the stacking posts 36C of the bottom tray C. Additionally, the lower surface 23 of front wall 20 of the middle tray B rests on the upper surface 25 of the rear wall of lower tray C and support surface 58 of middle tray B rest on surface 60 of lower tray C.

Figure 8:
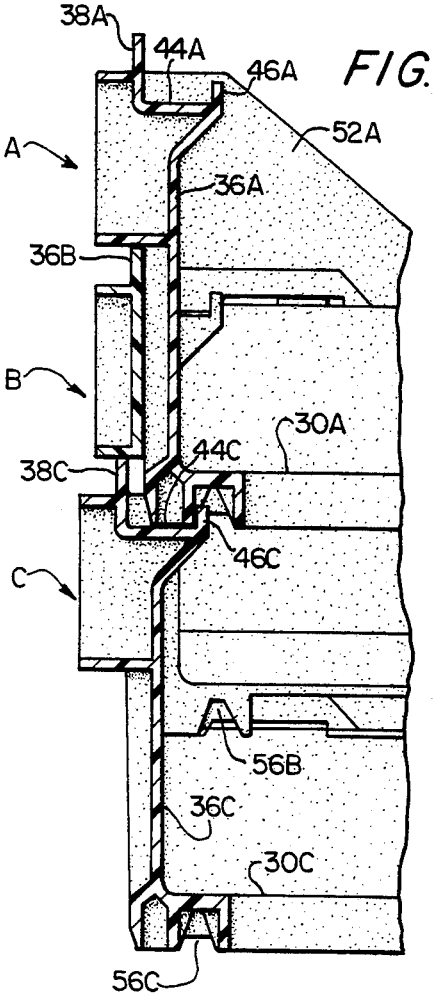
FIG. 8 is a transverse cross-sectional view of the side walls of the three identical multi-level trays or baskets of the stack of FIG. 6 in superposed alternating nested relationship taken through the walls along the left side of the stack.
Figure 9:
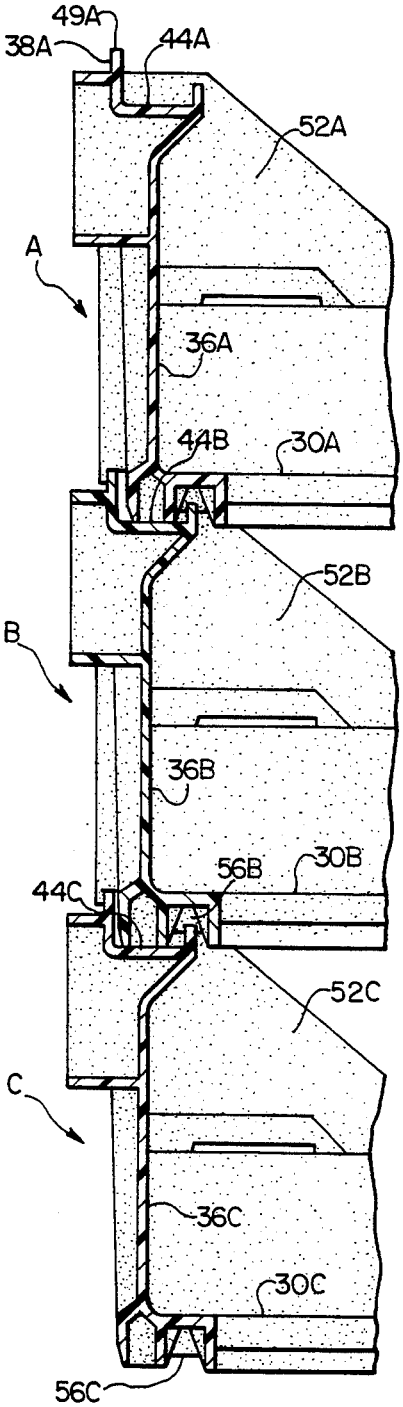
FIG. 9 is a transverse cross-sectional view of the left side walls of the basket in the stack of FIG. 7.

Thus, similarly configured baskets of the present invention can be nested inside of each other (as shown in FIG. 8) for a low stacking height; stacked on top of each other (as in FIG. 9), for a high stacking height; and in either the low, nested configuration, or the high, stacked configuration, can have a basket of smaller overall dimensions stacked on top of the upper one of the similarly configured baskets.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed:

1. A tray adapted for alternately stacking or nesting with a similarly configured tray comprising:

(a) a pair of opposed left and right side walls, a pair of opposed front and rear walls, a floor, and a plane of symmetry perpendicular to said floor, and parallel to and equidistant from said left and right side walls;

(b) said left and right side walls being mirror images of each other and each having a plurality of normally upright, spaced apart stacking posts of substantially uniform width and height, each of the stacking posts having a top end, a bottom end, an inner side and an outer side, the stacking posts being interconnected at their top ends by a vertical strip of material, said strip of material being spaced above the floor by a predetermined distance, the stacking posts being connected directly to the floor, thereby leaving a void that extends between each of the stacking posts and that extends from the floor to said vertical strip of material;

(c) said vertical strip having an upper rim extending along said vertical strip wherein said upper rim is a constant height for a forward portion of its length, inclines downwardly from front to rear from the rear extent of said constant height portion and terminates in a constant height at its rearmost extent; and (d) each of said stacking posts is flared inwardly at its top end which comprises a horizontally extending flat portion, said flat portion being cantilevered out from the inner side of the stacking post towards said plane of symmetry and a vertical lip provided at an edge of said horizontally extending flat portion closest to said plane of symmetry, thereby providing a surface on which a basket having smaller overall dimensions than said basket can be stacked.

2. The tray of claim 1, wherein said rear wall has a left end and a right end, said left end being connected to the inner side of a first one of said stacking posts, said right end being connected to the inner side of a second one of said stacking posts, said first and second stacking posts being spaced a substantially equal distance from said front wall.

3. The tray of claim 2, wherein said first one of said stacking posts and said second one of said stacking posts each has a downwardly extending lip at the bottom end of the outer side of the first and second stacking posts respectively.

4. The tray of claim 1, wherein the stacking posts are each connected to the floor by a connecting portion, the connecting portion having a top side and a bottom side, wherein an inverted V-shaped recess is formed in the bottom side of the connecting portion.

5. A tray in combination with at least one other similarly configured tray wherein each one of the trays comprises:

(a) a pair of opposed left and right side walls, a pair of opposed front and rear walls, a floor, and a plane of symmetry perpendicular to said floor, and parallel to and equidistant from said left and right side walls;

(b) said left and right side walls being mirror images of each other and each having a plurality of normally upright, spaced apart stacking posts of substantially uniform width and height, each of the stacking posts having a top end, a bottom end, an inner side and an outer side, the stacking posts being interconnected at their top ends by a vertical strip of material, said strip of material being spaced above the floor by a predetermined distance, the stacking posts connected directly to the floor, thereby leaving a void that extends between each of the stacking posts and that extends from the floor to said vertical strip of material;

(c) said vertical strip having an upper rim extending along said vertical strip wherein said upper rim is a constant height for a forward portion of its length, inclines downwardly from front to rear from the rear extent of said constant height portion and terminates in a constant height at its rearmost extent; and (d) each of the stacking posts is flared inwardly at its top end which comprises a horizontally extending flat portion, said flat portion being cantilevered out from the inner side of the stacking post towards said plane of symmetry and a vertical lip provided at an edge of said horizontally extending flat portion closest to said plane of symmetry, thereby providing a surface on which a tray having smaller overall dimensions than said tray can be stacked; and wherein:

all of the trays have predetermined dimensions so that nesting a first one of the trays on top of a second one of the trays which is nested in turn on top of a third one of the trays results in the bottom ends of the stacking posts of said first one of the trays resting on the horizontally extending flat portions at the top ends of the stacking posts of the third one of the trays.

6. The tray as recited in claim 5, wherein:

said rear wall has a left end and a right end, said left end being connected to the inner side of a first one of the stacking posts, said right end being connected to the inner side of a second one of the stacking posts, and said first and second stacking posts being spaced a substantially equal distance from each other and from said front wall.

7. The tray of claim 6, wherein:

said first one of the stacking posts and said second one of the stacking posts each to have a downwardly extending lip at the bottom end of the outer side of said first and said second stacking posts respectively.

8. The tray of claim 7, wherein:

the stacking posts each being connected to the floor by a connecting portion, the connecting portion having a top side and a bottom side, wherein an inverted V-shaped recess is formed in the bottom side of the connecting portion.

9. The tray of claim 5, wherein:

any one of the trays nests with any other of the trays with their respective stacking posts being interleaved when said one of the baskets is rotated 180 degrees from a position in superposed relationship with said other of the baskets.

10. The tray of claim 7, wherein:

the downwardly extending lips of any one of the trays guide said any one of the trays along the upper rims of any other of the trays when sliding said any one of the baskets into a stacked position on top of said any other of the trays.

11. The tray of claim 8, wherein:

the V-shaped recesses of any one of the trays rest over the vertical lips of any other of the baskets when said any one of the trays is stacked on top of said any other of the trays.

* * * * *